US011097308B2

(12) United States Patent
Fang

(10) Patent No.: US 11,097,308 B2
(45) Date of Patent: Aug. 24, 2021

(54) LED-UV CURING DRYER

(71) Applicants: STARS UNION EQUIPMENT TECHNOLOGY (JIANGSU)CO., LTD., Zhangjiagang (CN); Suzhou Kisinhom Machinery Equipment Co., Ltd., Kunshan (CN)

(72) Inventor: Yin Fang, Zhangjiagang (CN)

(73) Assignees: STARS UNION EQUIPMENT TECHNOLOGY (JIANGSU) CO., LTD., Zhangjiagang (CN); Suzhou Kisinhom Machinery Equipment Co., Ltd., Kunshan (CN)

( * ) Notice: Subject to any disclaimer, the term of this patent is extended or adjusted under 35 U.S.C. 154(b) by 0 days.

(21) Appl. No.: 16/479,131

(22) PCT Filed: Mar. 19, 2019

(86) PCT No.: PCT/CN2019/078743

§ 371 (c)(1),
(2) Date: Jul. 19, 2019

(87) PCT Pub. No.: WO2020/042599

PCT Pub. Date: Mar. 5, 2020

(65) Prior Publication Data

US 2021/0205840 A1 Jul. 8, 2021

(30) Foreign Application Priority Data

Aug. 30, 2018 (CN) ..... 201811000743.3

(51) Int. Cl.
*B05D 3/06* (2006.01)

(52) U.S. Cl.
CPC ..... *B05D 3/067* (2013.01); *B05D 3/068* (2013.01)

(58) Field of Classification Search
CPC ..... B05D 3/067; B05D 3/068
(Continued)

(56) References Cited

U.S. PATENT DOCUMENTS 5,345,863 A * 9/1994 Kurata ..... B41J 11/002 101/126
5,933,978 A * 8/1999 Lehtinen ..... D21F 5/004 34/419
2004/0130077 A1* 7/2004 Detronde ..... C04B 5/06 266/186

FOREIGN PATENT DOCUMENTS

CN 106799342 6/2017
CN 206425209 8/2017
(Continued)

OTHER PUBLICATIONS

Chinese Internation Search Report in PCT/CN2019/078743 dated Mar. 19, 2019.

(Continued)

*Primary Examiner* — Nicole M Ippolito
(74) *Attorney, Agent, or Firm* — DLA Piper LLP (US)

(57) ABSTRACT

An LED-UV curing dryer includes a frame with a driving motor and profiles at both ends. A workpiece transport mechanism includes a drive roller, a driven roller, and a stainless steel screen mesh, wherein the driven roller and the drive roller are located at two ends of the frame and connected with the profiles, respectively. The stainless steel screen mesh acts as a transport carrier and cooperates with the drive roller and the driven roller to form a conveying mechanism. An illumination mechanism includes a light box provided with a lamp bead board. A number of LED light sources are provided on a surface of the lamp bead board facing the stainless steel screen mesh. A water-cooling mechanism is located on a surface of the lamp lead board remote from the stainless steel screen mesh.

10 Claims, 7 Drawing Sheets

(58) Field of Classification Search
USPC ..... 250/493.1, 494.1, 504 R
See application file for complete search history.

(56) References Cited

FOREIGN PATENT DOCUMENTS

| | | |
|---|---|---|
| CN | 206454871 | 9/2017 |
| CN | 206464207 | 9/2017 |
| CN | 207481439 | 6/2018 |
| CN | 109158278 | 1/2019 |
| TW | 201536433 | 10/2015 |

OTHER PUBLICATIONS

Written Opinion of Internation Search Report in PCT/CN2019/078743 dated Mar. 19, 2019.
English-language abstract of CN109158278 published Jan. 8, 2019.
English-language abstract of CN106799342 published Jun. 6, 2017.
English-language abstract of CN206425209 published Aug. 22, 2017.
English-language abstract of CN207481439 published Jun. 12, 2018.
English-language abstract of CN206464207 published Sep. 5, 2017.
English-language abstract of CN206454871 published Sep. 1, 2017.
English-language abstract of TW201536433 published Oct. 1, 2015.

* cited by examiner

LED-UV CURING DRYER

CROSS-REFERENCE TO RELATED APPLICATIONS

This application is a U.S. National Stage Application of International Application No. PCT/CN2019/078743 filed, Mar. 19, 2019, which claims priority to Chinese Patent Application No. 201811000743.3, filed with the Chinese Patent Office (CNIPA) on Aug. 30, 2018, entitled "LED-UV Curing Dryer", all of which are incorporated herein by reference in their entireties.

TECHNICAL FIELD

The present disclosure pertains to the technical field of UV lacquer (UV coating) curing, and in particular relates to an LED-UV curing dryer.

BACKGROUND ART

A UV lamp is a gas discharge lamp, in which a certain amount of high-purity mercury is added to a vacuum quartz tube, and a voltage difference (voltage drop) is produced between the electrodes at both ends to generate an ion discharge so as to generate ultraviolet radiation, and the UV lamp is an abbreviation for the ultraviolet lamp.

In the existing UV lacquer curing devices, in general, high-voltage mercury lamps and gallium lamps and the like are used for curing UV lacquer coated on surfaces of wood products, such that the UV lacquer of the coating layer can be cured quickly. However, this way method brings many disadvantages, such as high energy consumption, short service life, high temperature in use, easy loss, pollution, and other problems.

SUMMARY

The present disclosure overcomes the deficiencies in the prior art and provides an LED-UV curing dryer in which an LED is used as a light source for curing, i.e., a light emitting diode that radiates UV light. Electromagnetic radiation in the ultraviolet spectral range is emitted by the material of the LED wafer itself after it is energized. A circulating water-cooling system is provided, and it is equipped with a transport mechanism with stainless steel screen mesh, a transport tension adjustment mechanism, and so on. A workpiece transported on the surface of the steel screen mesh is rapidly cured at a lower temperature inside the machine.

In order to achieve the above object, the present disclosure adopts the following technical solution: an LED-UV curing dryer, comprising: a frame, the frame is provided thereon with a driving motor, both ends of the frame are provided with a profile; a workpiece transport mechanism comprising a drive roller, a driven roller, and a stainless steel screen mesh, wherein the drive roller is connected with a rotating shaft end of the driving motor via a chain, the driven roller and the drive roller are located at two ends of the frame and connected with the profiles, respectively, and the stainless steel screen mesh acts as a transport carrier and cooperates with the drive roller and the driven roller to form a conveying mechanism; an illumination mechanism comprising a light box, wherein the light box is provided with a lamp bead board, and a number of LED light sources are provided on a surface of the lamp bead board facing the stainless steel screen mesh; and a water-cooling mechanism located on a surface of the lamp lead board remote from the stainless steel screen mesh.

In a preferred embodiment of the present disclosure, one end of the drive roller and one end of the driven roller at a same are each provided with a fixation slider, and the other end of the drive roller and the other end of the driven roller at a same side are each connected with the respective profile via a bearing pedestal (base), wherein each fixation slider is connected with the respective profile via a slider fixing plate.

In a preferred embodiment of the present disclosure, the LED-UV curing dryer further comprises: anti-deviation rolls, wherein both ends of each anti-deviation roll are connected with the profiles via anti-deviation roll fixing plates respectively, two anti-deviation rolls are provided and located at both ends of the profiles, respectively, each anti-deviation roll is provided with end caps for anti-deviation roll, and the anti-deviation rolls cooperate with the stainless steel screen mesh.

In a preferred embodiment of the present disclosure, the LED-UV curing dryer further comprises: tie rod square tubes, wherein both ends of each tie rod square tube are connected with the respective profiles via tie rod fixing plates, and two tie rod square tubes are provided and located at both ends of the profiles, respectively.

In a preferred embodiment of the present disclosure, a spacer is provided on the profiles, and the stainless steel screen mesh is connected with the profiles at both ends of the frame via a bedplate.

In a preferred embodiment of the present disclosure, two spacers are provided and located at both ends of the profiles, respectively, the inside of the spacer is a hollow structure, and both sides of the bedplate are connected with the respective profiles via connecting plates.

In a preferred embodiment of the present disclosure, a lamp cover is provided in the light box, and the lamp bead board is located inside the lamp cover.

In a preferred embodiment of the present disclosure, the light box is provided with an exhaust pipe, the lamp cover is provided with a lamp cover lifting holder and a fixing mechanism at both ends thereof, a fixed base is provided at the bottom of each lamp cover lifting holder, and the lamp bead board is provided thereon with a wiring cover.

In a preferred embodiment of the present disclosure, the water-cooling mechanism comprises a water inlet pipe and a water outlet pipe, wherein both the water inlet pipe and the water outlet pipe are corresponding to the position of the lamp bead board, and both the water inlet pipe and the water outlet pipe are connected with an external water pump.

In a preferred embodiment of the present disclosure, the LED-UV curing dryer further comprises: a control system comprising a control box, where a controller is provided in the control box, the controller is electrically connected with the driving motor, a control knob is provided on a surface of the control box, and the control knob is electrically connected with the controller; and a main machine power source, wherein the main machine power source is located in the frame, the main machine power source is electrically connected with the driving motor, and the LED light sources on the lamp bead board.

The present disclosure solves the deficiencies existing in the background art, and the present disclosure has the following advantageous effects:

(1) environmentally friendly LED technology is used instead of the mercury lamp containing heavy metal contaminants, such that ozone is not generated and environmental pollution is avoided;

(2) LED-UV curing technology is used such that the curing efficiency is increased, and the curing of UV lacquer can be completed within a few seconds without preheating operation;

(3) in the presence of the water-cooling mechanism, the temperature in the light box can be quickly lowered to avoid damage to the workpiece due to excessive heat;

(4) the present disclosure can save equipment maintenance cost and increase the service life of the LED-UV lamp of the machine;

(5) in the present disclosure, the stainless steel screen mesh is used as a workpiece transportation carrier instead of a belt. Since the stainless steel screen mesh has the advantages such as high temperature resistance, corrosion resistance and easy replacement, and as the stainless steel screen mesh has holes on its surface, a good heat dissipating property is brought about, thus the stainless steel screen mesh is used as a workpiece transportation carrier.

BRIEF DESCRIPTION OF DRAWINGS

The present disclosure is further described below with reference to the accompanying drawings and embodiments.

In the figures: 1. frame; 2. profile; 3. driving motor; 4. drive roller; 5. fixation slider; 6. slider fixing plate; 7. bearing pedestal; 8. anti-deviation roll; 9. anti-deviation roll fixing plate; 10. end cap for anti-deviation roll; 11. tie rod square tube; 12. tie rod fixing plate; 13. driven roller; 14. bedplate; 15. stainless steel screen mesh; 16. light box; 17. lamp cover; 18. lamp bead board; 19. lamp cover lifting holder; 20. fixed base; 21. wiring cover; 22. fixing mechanism; 23. water inlet pipe; 24. water outlet pipe; 25. exhaust pipe; 26. main machine power source; 27. control box; 28. control knob; 29. spacer.

DETAILED DESCRIPTION OF EMBODIMENTS

The present disclosure will now be described in further detail with reference to the accompanying drawings and embodiments, and these drawings are all simplified schematic views schematically illustrating the basic structure of the present disclosure, and therefore only show the configuration related to the present disclosure.

Figure 1:
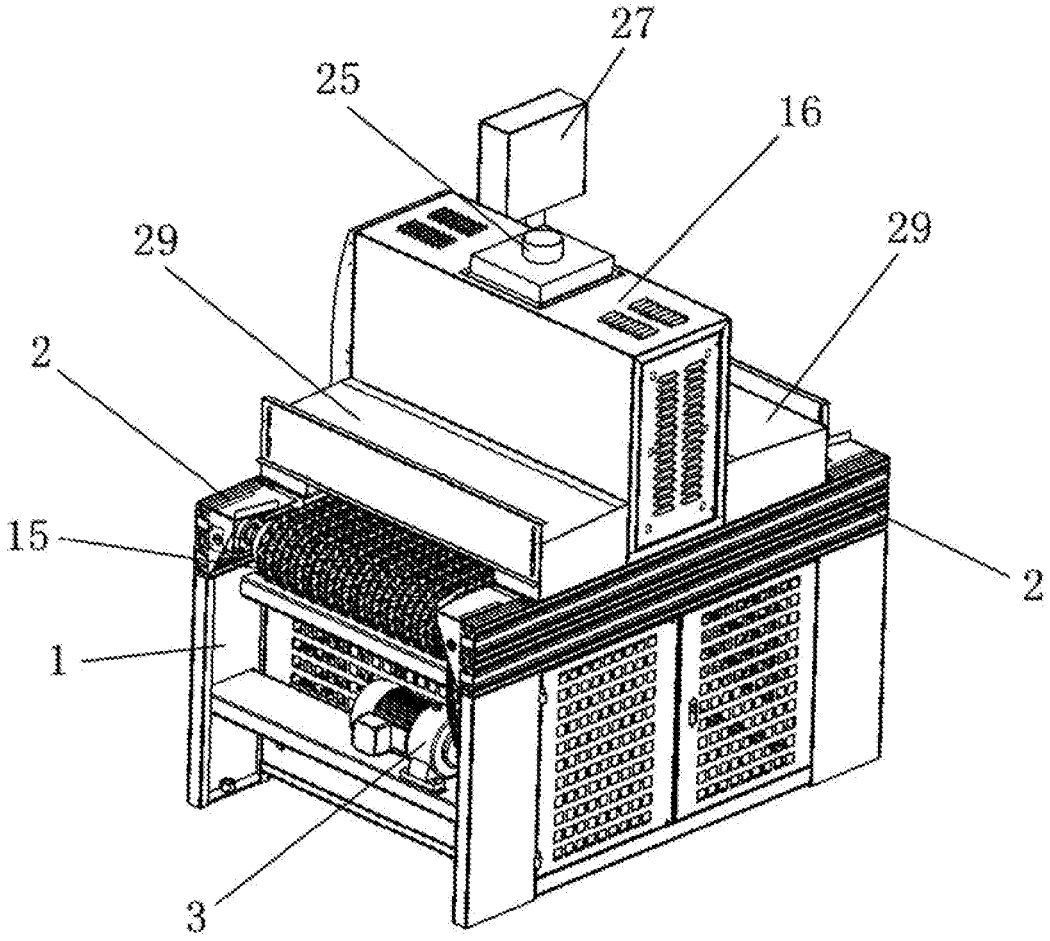
FIG. 1 is a schematic view showing the overall structure of a preferred embodiment of the present disclosure.
Figure 2:
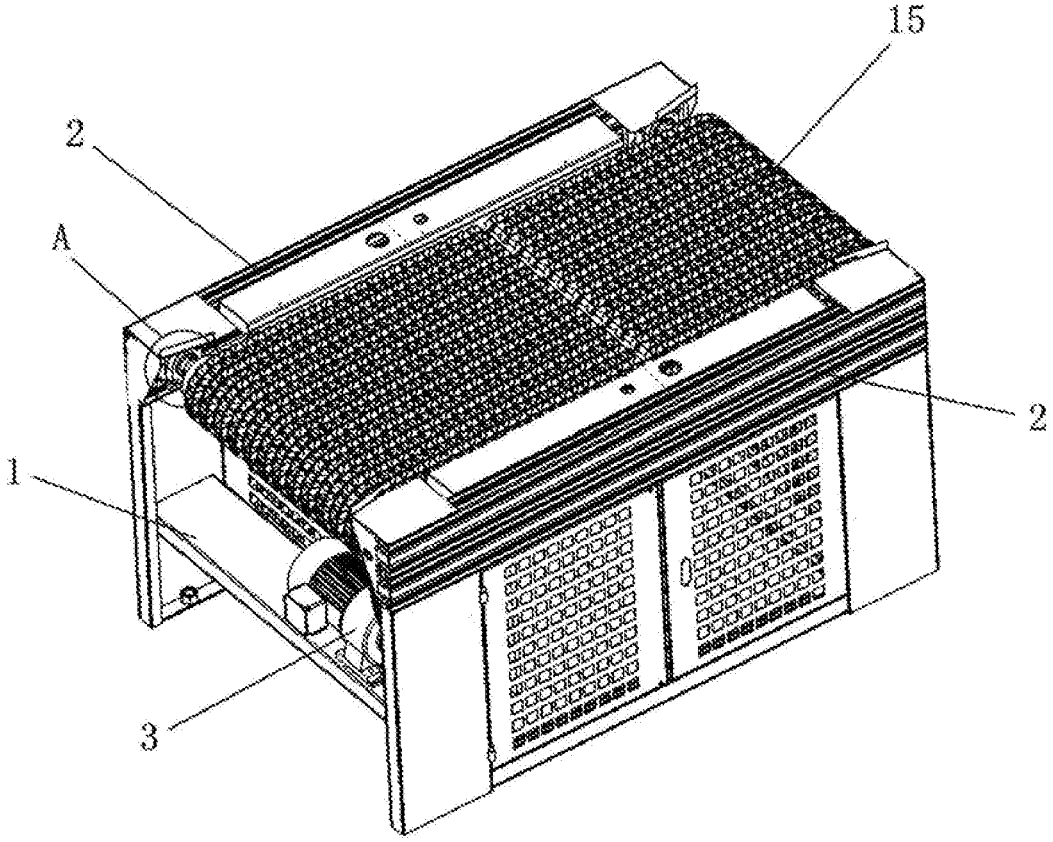
FIG. 2 is a schematic structural view of a workpiece transport mechanism in a preferred embodiment of the present disclosure.
Figure 3:
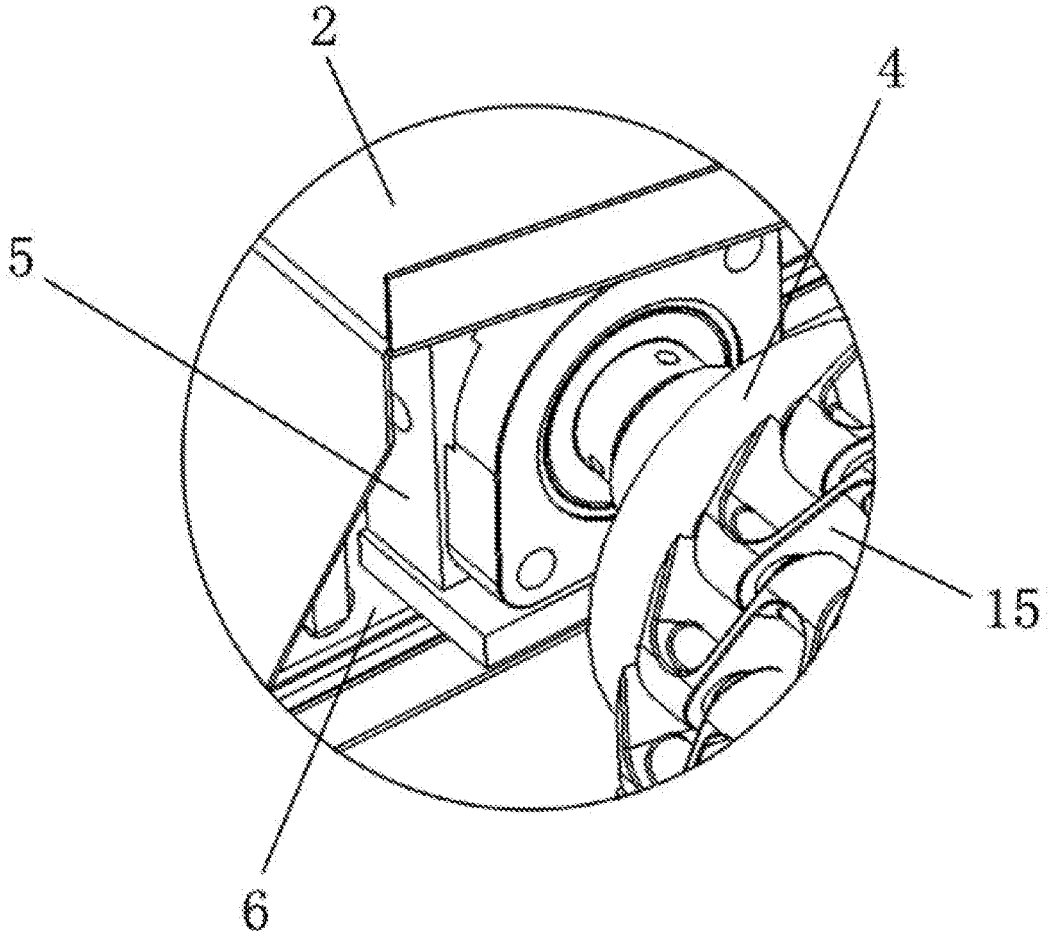
FIG. 3 is an enlarged view of A in FIG. 2.
Figure 4:
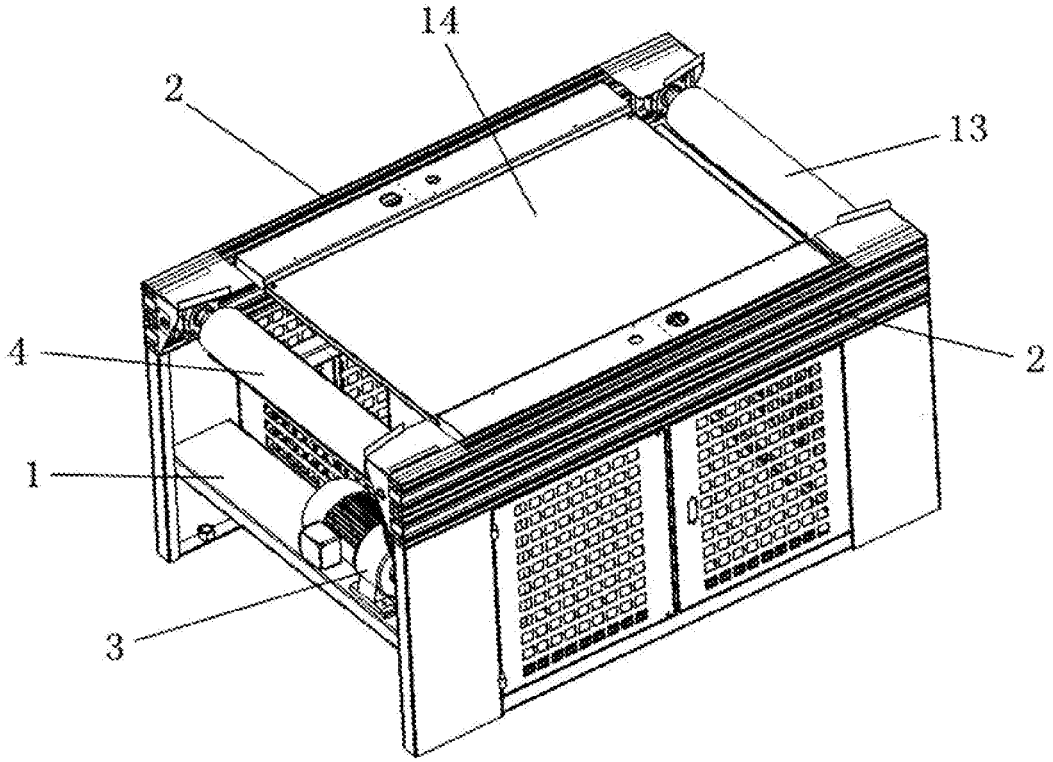
FIG. 4 is a schematic view showing the structure in FIG. 2 from which a stainless steel screen mesh is removed.
Figure 5:
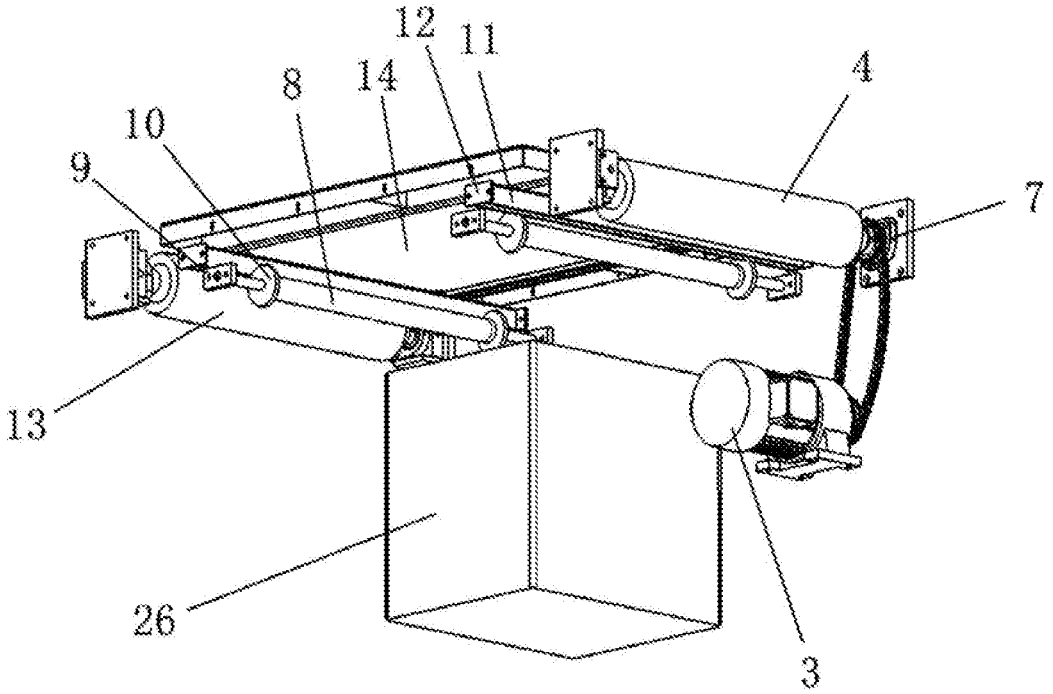
FIG. 5 is a schematic partial structural view of a workpiece transport mechanism in a preferred embodiment of the present disclosure.
Figure 6:
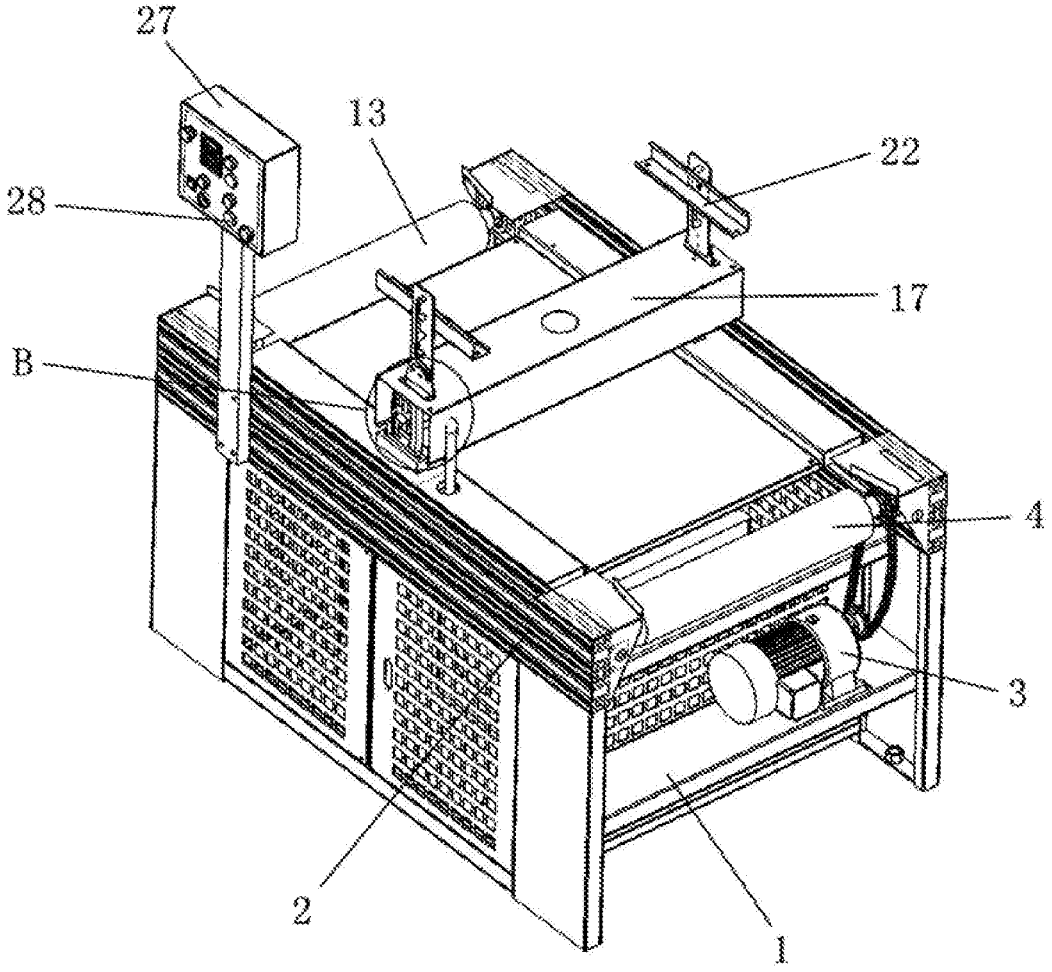
FIG. 6 is a schematic partial structural view of a preferred embodiment of the present disclosure.
Figure 7:
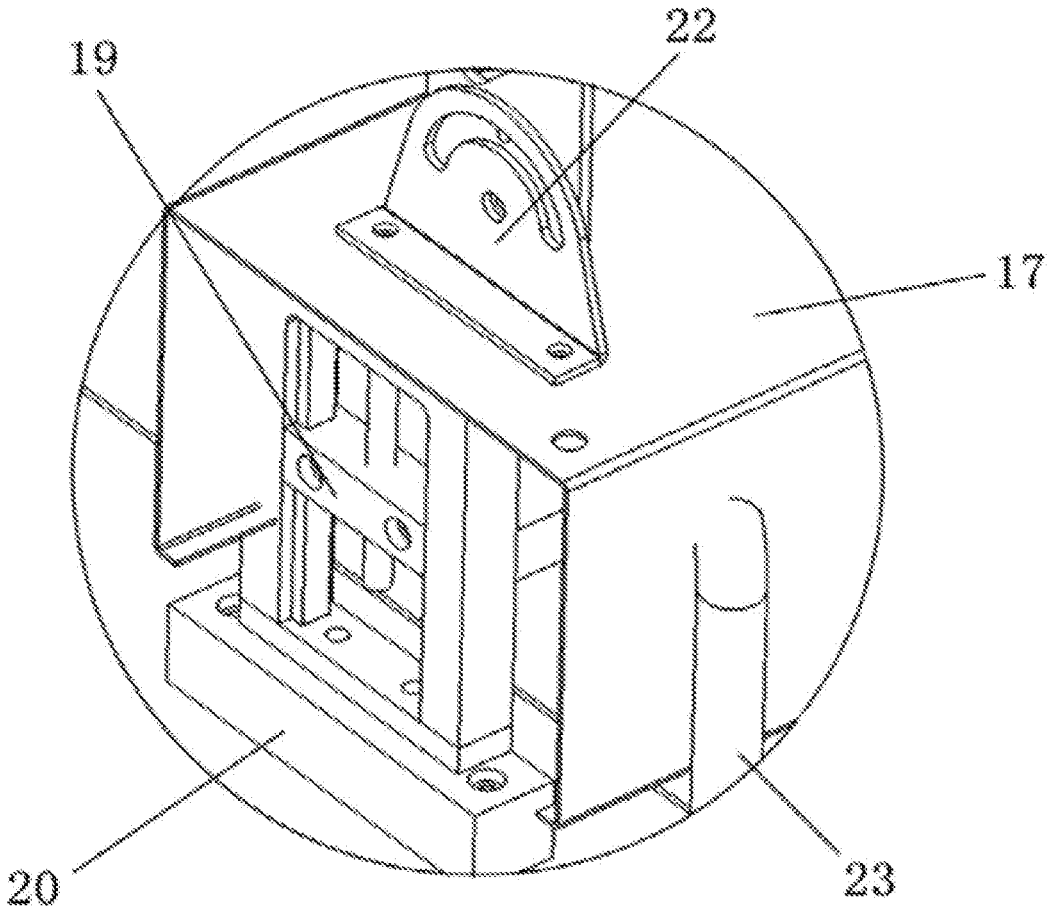
FIG. 7 is an enlarged view of B in FIG. 6.
Figure 8:
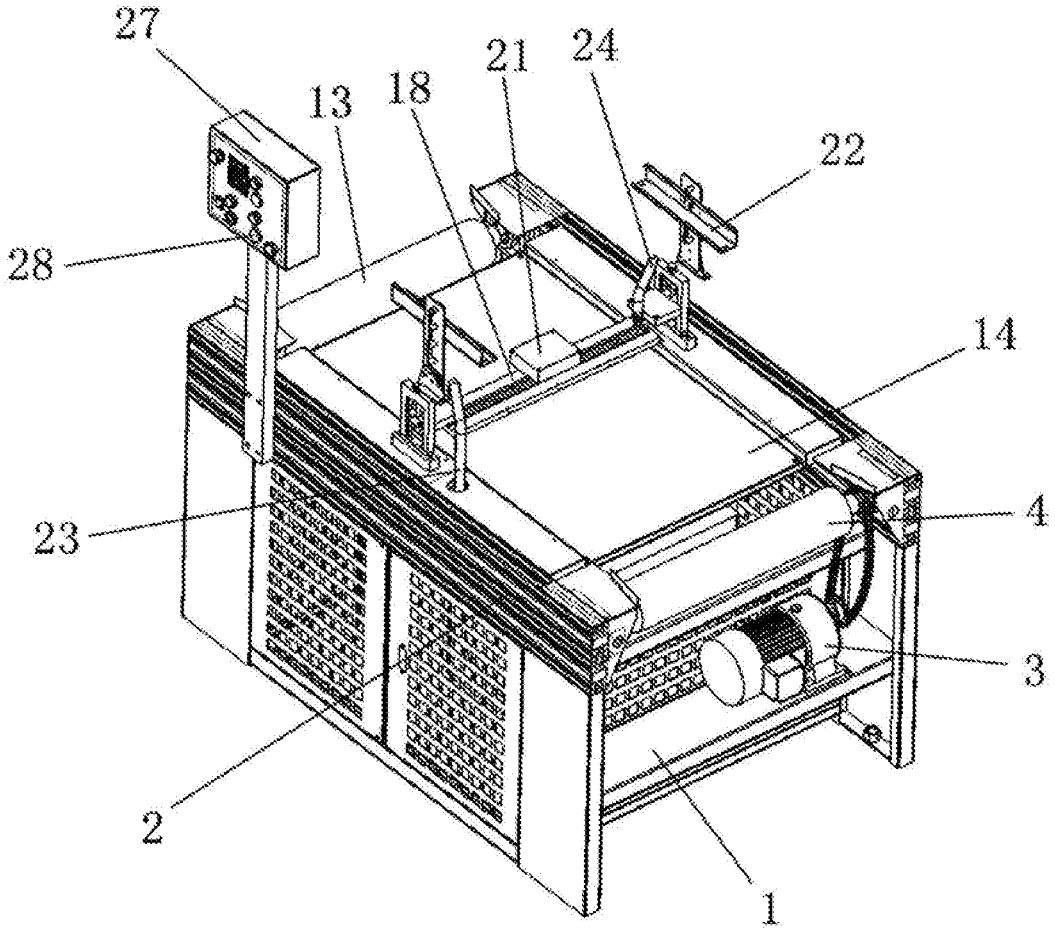
FIG. 8 is a schematic view showing the structure in FIG. 6 from which a lamp cover is removed.

As shown in FIG. 1 to FIG. 8, an LED-UV curing dryer comprises: a frame 1, the frame 1 is provided thereon with a driving motor 3, both ends of the frame 1 are provided with profiles 2; a workpiece transport mechanism comprising a drive roller 4, a driven roller 13, and a stainless steel screen mesh 15, wherein the drive roller 4 is connected with a rotating shaft end of the driving motor 3 via a chain, the driven roller 13 and the drive roller 4 are located at two ends of the frame 1 and connected with the profiles 2, respectively, and the stainless steel screen mesh 15 acts as a transport carrier and cooperates with the drive roller 4 and the driven roller 13 to form a conveying mechanism; an illumination mechanism comprising a light box 16, wherein the light box 16 is provided with a lamp bead board 18, and a number of LED light sources are provided on a surface of the lamp bead board 18 facing the stainless steel screen mesh 15; and a water-cooling mechanism located on a surface of the lamp lead board 18 remote from the stainless steel screen mesh 15. In the present disclosure, environmentally friendly LED technology is used instead of the mercury lamp containing heavy metal contaminants such that ozone is not generated thus environmental pollution is avoided, moreover due to use of LED-UV curing technology, the curing efficiency is increased, and the curing of UV lacquer can be completed within a few seconds without preheating operation. In the present disclosure, when in use, the frame 1 cooperates with the profiles 2 to achieve supporting and positioning of the whole device. Moreover, since the drive roller 4, the stainless steel screen mesh 15, and the driven roller 13 form a conveying mechanism, when the driving motor 3 drives the drive roller 4 to rotate, the driven roller 13 may move synchronously under the action of the stainless steel screen mesh 15, wherein the stainless steel screen mesh 15 acts similarly to a conveyor belt structure, the end of the driven roller 13 is a feeding end, a workpiece located on the stainless steel screen mesh 15 is moved into the light box 16 from the end of the driven roller 13, and after the workpiece enters the light box 16, the workpiece is illuminated by the LED light sources. Electromagnetic radiation in the ultraviolet spectral range is emitted by the material of the LED wafer itself after it is energized, such that the workpiece on the surface of the stainless steel screen mesh 15 can be quickly cured. Furthermore, due to use of the water-cooling mechanism, the temperature in the light box 16 can be quickly lowered to avoid damage to the workpiece caused by excessive heat. In the present disclosure, the stainless steel screen mesh 15 is used as a workpiece transportation carrier instead of a belt. Since the stainless steel screen mesh 15 has advantages such as high temperature resistance, corrosion resistance and easy replacement, and as the stainless steel screen mesh 15 has holes on its surface, a good heat dissipating property is brought about, therefore the stainless steel screen mesh 15 is used as the workpiece transportation carrier.

Further, one end of the drive roller 4 and one end of the driven roller 13 at a same side are each provided with a fixation slider 5, and the other end of the drive roller 4 and the other end of the driven roller 13 at a same side are each connected with the respective profile 2 via a bearing pedestal 7, and each fixation slider 5 is connected with the respective profile 2 via a slider fixing plate 6, wherein the fixation sliders 5 are used such that the movement direction of the stainless steel screen mesh 15 can be adjusted to a certain extent, and the bearing pedestals 7 are used to fixe one end of each of the drive roller 4 and the driven roller 13.

Further, during use, the present disclosure further comprises: anti-deviation rolls 8, both ends of each anti-deviation roll 8 are connected with the profiles 2 via anti-deviation roll fixing plates 9 respectively, two anti-deviation rolls 8 are provided and located at both ends of the profiles 2, respectively, each anti-deviation roll 8 is provided with end caps 10 for anti-deviation roll, and the anti-deviation rolls 8 cooperate with the stainless steel screen mesh 15. In the presence of the anti-deviation rolls 8, the stainless steel screen mesh 15 is positionally restrained when the stainless steel screen mesh 15 is being driven to move, and the end caps 10 for anti-deviation roll are used to prevent the deviation of the stainless steel screen mesh 15.

Further, during use, the present disclosure further comprises: tie rod square tubes 11, both ends of each tie rod square tube 11 are connected with the profiles 2 via tie rod fixing plates 12, and two tie rod square tubes 11 are provided and located at both ends of the profiles 2, respectively. The tie rod square tubes 11 are used to enhance the strength of the profiles 2.

Specifically, a spacer 29 is provided on the profiles 2. In the presence of the spacer 29, a workpiece to be cured can be isolated from the outside, and external light can be blocked, so that a relatively closed environment is formed inside, thereby ensuring that the workpiece is not affected by the outside during the curing process and is prevented from being contaminated. The stainless steel screen mesh 15 is connected with the profiles 2 at both ends of the frame 1 via a bedplate 14. In the presence of the bedplate 14, the weight of the workpiece on the surface of the stainless steel screen mesh 15 is supported, and it is ensured that no deviation in position of the workpiece can be ensured while the stainless steel screen mesh 15 is passing through the light box 16, whereby the smooth progress of the curing operation can be ensured.

Further, two spacers 29 are provided and located at both ends of the profiles 2, respectively, each spacer 29 is of a hollow structure, and both sides of the bedplate 14 are connected with the respective profiles 2 via connecting plates. The connecting plates connect the profiles 2 and the bedplate 14 to prevent the deviation in position of the bedplate 14.

Specifically, a lamp cover 17 is provided in the light box 16, and the lamp bead board 18 is located inside the lamp cover 17.

Further, the light box 16 is provided thereon with an exhaust pipe 25. Due to use of the exhaust pipe 25, gas generated in the light box 16 can be rapidly discharged. The lamp cover 17 is provided with a lamp cover lifting holder 19 and a fixing mechanism 22 at both ends thereof, a fixed base 20 is provided at the bottom of each lifting holder of the lamp cover 17, and the lamp bead board 18 is provided thereon with a wiring cover 21. In the presence of the lamp cover lifting holder 19, the height at which the lamp cover 17 is located can be changed, the fixing mechanism 22 achieves the fixation of the lamp cover 17, the fixed base 20 fixes the bottom of the lamp cover lifting holder 19, and the wiring cover 21 is configured for wire arrangement.

Specifically, the water-cooling mechanism comprises a water inlet pipe 23 and a water outlet pipe 24, wherein both the water inlet pipe 23 and the water outlet pipe 24 are corresponding to the position of the lamp bead board 18, and both the water inlet pipe 23 and the water outlet pipe 24 are connected with an external water pump. After cooling water is introduced from the water inlet pipe 23 onto the surface of the lamp bead board 18, since the surface of the lamp bead board 18 is provided with a linear groove, the cooling water is introduced into the groove to achieve a reduction in temperature in the light box 16, and then the cooling water is discharged through the water outlet pipe 24 such that the water-cooling operation is completed.

Further, during use, the present disclosure further comprises: a control system comprising a control box 27, wherein a controller is provided in the control box 27, the controller is electrically connected with the driving motor 3, a control knob 28 is provided on a surface of the control box 27, and the control knob is electrically connected with the controller; and a main machine power source 26, wherein the main machine power source 26 is located in the frame 1, and the main machine power source 26 is electrically connected with the driving motor 3, and the LED light sources on the lamp bead board 18. In the presence of the control system, which is configured to control the whole device, the use of the control knob 28 facilitates an operation performed by an operator and reduces the labor intensity of the operator, the main machine power source 26 supplies power to the inside of the device, and the main machine power source 26 is provided with a water inlet configured to receive water flowing out from the water outlet pipe 24.

In summary, in the present disclosure, an LED is used as a light source for curing, electromagnetic radiation in the ultraviolet spectral range is emitted by the material of the LED wafer itself after it is energized, and it is equipped with a water-cooling mechanism, a transport mechanism with stainless steel screen mesh, a transport tension adjustment mechanism, and so on, such that a workpiece transported on the surface of the stainless steel screen mesh 15 is quickly cured at a lower temperature inside the machine, the curing efficiency is increased, and the curing of UV lacquer can be completed within a few seconds without preheating operation. Moreover, the present disclosure can save equipment maintenance cost and increase the service life of the LED-UV lamp of the machine.

The above description is suggested based on an ideal embodiment of the present disclosure, and various variations and modifications can be made in light of the above description by those skilled in the art without departing from the scope of the technical concept of the present disclosure. The technical scope of the present disclosure is not limited to the description in the specification, and the technical scope should be determined according to the scope of the claims.

The invention claimed is:

1. An LED-UV curing dryer, comprising:

a frame, wherein the frame is provided thereon with a driving motor, and each ends of the frame is provided with a profile;

a workpiece transport mechanism comprising a drive roller, a driven roller, and a stainless steel screen mesh, wherein the drive roller is connected with a rotating shaft end of the driving motor via a chain, the driven roller and the drive roller are located at two ends of the frame and connected with profiles, respectively, and the stainless steel screen mesh acts as a transport carrier and cooperates with the drive roller and the driven roller to form a conveying mechanism;

an illumination mechanism comprising a light box, wherein the light box is provided with a lamp bead board, and a number of LED light sources are provided on a surface of the lamp bead board facing the stainless steel screen mesh; and a water-cooling mechanism located on a surface of the lamp lead board remote from the stainless steel screen mesh.

2. The LED-UV curing dryer according to claim 1, wherein one end of the drive roller and one end of the driven roller at a same side are provided each with a fixation slider, and the other end of the drive roller and the other end the driven roller at a same side are each connected with the respective profile via a bearing pedestal, and each fixation slider is connected with the respective profile via a slider fixing plate.

3. The LED-UV curing dryer according to claim 1, further comprising:

anti-deviation rolls, wherein both ends of each anti-deviation roll are connected with the profiles via anti-deviation roll fixing plates respectively, two anti-deviation rolls are provided and located at both ends of the profiles respectively, each anti-deviation roll is provided with end caps for anti-deviation roll, and the anti-deviation rolls cooperate with the stainless steel screen mesh.

4. The LED-UV curing dryer according to claim 1, further comprising:

tie rod square tubes, wherein both ends of each tie rod square tube are connected with the profiles via tie rod fixing plates respectively, and two tie rod square tubes are provided and located at both ends of the profiles, respectively.

5. The LED-UV curing dryer according to claim 1, wherein a spacer is provided on the profiles, and the stainless steel screen mesh is connected with the profiles at both ends of the frame via a bedplate.

6. The LED-UV curing dryer according to claim 5, wherein two spacers are provided and located at both ends of the profiles, respectively, each spacer is of a hollow structure, and both sides of the bedplate are connected with the profiles via connecting plates respectively.

7. The LED-UV curing dryer according to claim 1, wherein a lamp cover is provided in the light box, and the lamp bead board is located inside the lamp cover.

8. The LED-UV curing dryer according to claim 7, wherein the light box is provided thereon with an exhaust pipe, each end of the lamp cover is provided with a lamp cover lifting holder and a fixing mechanism, a fixed base is provided at the bottom of each lamp cover lifting holder, and the lamp bead board is provided thereon with a wiring cover.

9. The LED-UV curing dryer according to claim 1, wherein the water-cooling mechanism comprises a water inlet pipe and a water outlet pipe, both the water inlet pipe and the water outlet pipe are corresponding to a position of the lamp bead board, and both the water inlet pipe and the water outlet pipe are connected with an external water pump.

10. The LED-UV curing dryer according to claim 1, further comprising:

a control system comprising a control box, wherein a controller is provided in the control box, the controller is electrically connected with the driving motor, a control knob is provided on a surface of the control box, and the control knob is electrically connected with the controller; and a main machine power source, wherein the main machine power source is located in the frame, and the main machine power source is electrically connected with the driving motor, and the LED light sources on the lamp bead board.

* * * * *